United States Patent [19]

Shiraki

[11] 4,120,163

[45] Oct. 17, 1978

[54] SOIL TREATMENT

[75] Inventor: Hisashi Shiraki, Fuchu, Japan

[73] Assignee: Kitagawa Iron Works Co., Ltd., Japan

[21] Appl. No.: 812,930

[22] Filed: Jul. 1, 1977

Related U.S. Application Data

[63] Continuation of Ser. No. 610,217, Sep. 4, 1975, abandoned.

[51] Int. Cl.[2] ..... E02D 3/12

[52] U.S. Cl. ..... 405/264; 405/266

[58] Field of Search ..... 61/35, 36 R, 50, 63; 52/169, 742; 404/75, 76

[56] References Cited

U.S. PATENT DOCUMENTS

| | | | |
|---|---|---|---|
| 1,706,002 | 3/1929 | Sipe | 61/50 |
| 3,023,585 | 3/1962 | Liver | 61/36 R |
| 3,667,236 | 6/1972 | Rosene | 61/36 C |
| 3,800,544 | 4/1974 | Nakanismi | 61/35 |
| 4,072,017 | 2/1978 | Shiraki | 61/35 |

*Primary Examiner*—Mervin Stein
*Assistant Examiner*—Alex Grosz
*Attorney, Agent, or Firm*—William Anthony Drucker

[57] ABSTRACT

A method and apparatus for preparing a stabilized and hardened layer, by which extensive and deep-layered zones of clay, silt, and/or sand (hereinafter referred in as "Weak Soil Layer") in such places as rivers, lakes, marshes, harbors and/or the sea may be easily turned into stabilized foundation ground necessary for civil construction, the surface layer of said weak soil layer being partially or wholly turned into stabilized foundation ground at or to a fixed depth by stabilization treatment of said weak soil layer with a solidifier agent including cement.

2 Claims, 7 Drawing Figures

SOIL TREATMENT

This is a continuation of Ser. No. 610,217 filed Sept. 4, 1975, now abandoned.

BACKGROUND OF THE INVENTION

Methods of banking and piling have been conventionally employed to turn such weak soil layer in rivers and harbors into a stabilized foundation ground necessary for civil construction such as roads, banks, and factory sites by stabilization treatment of said weak soil layers. In these cases, the banking construction method is oridinarily employed for the purpose. However, a great deal of sand and many days of work are required for reclamation. On the other hand, with the piling method, some piles must be driven in through the weak soil layer until they reach a rock ground base. Thereafter, plate materials, nets, mats and/or sheets, on which banking is carried out and structures are built, are arranged and provided on and around said piles. Though said piling method appears simple, it requires highly-specialized knowledge and skills, and engineers with many years experience, when said piling work is carried out at all necessary points by use of piling machines, if said weak soil layer covers a wide area as may be the case in lakes, marshes, harbors, and the sea. Furthermore, it is unavoidable that said piling work costs a great deal and requires many days of construction work, thereby causing long-term delays.

SUMMARY OF THE INVENTION

An important object of the present invention is accordingly to provide a method of treatment, and apparatus therefor, by which such large and deep-layered weak soil layers in rivers, lakes, marshes, harbors, and the sea are effectively and efficiently hardened for civil construction.

Another important object of the present invention is to provide stabilized foundation ground necessary for civil construction, in a short time and at an economical low cost.

A further important object of the present invention is to provide equipment which can carry out the above objects in an extremely effective and suitable manner.

BRIEF DESCRIPTION OF THE DRAWINGS

The above and other objects are accomplished by the invention, a preferred embodiment of which is shown by way of example in the accompanying drawings, herein described in detail. Various modifications and changes in details of construction are comprehended within the scope of the appended claims.

In the drawings.

DESCRIPTION OF THE PREFERRED EMBODIMENT

Figure 1:
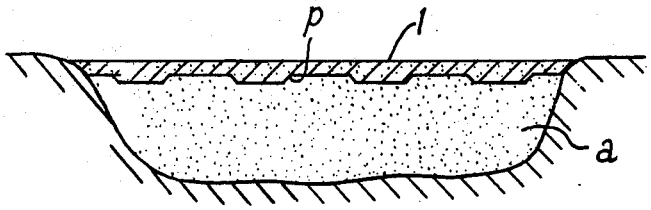
FIG. 1 is a sectional elevation illustration how an entire surface layer of weak soil layer is treated and hardened to a fixed depth.

FIG. 1 is a longitudinal sectional view of a portion of reclaimed land provided by the method of the present invention. As shown in FIG. 1, only the surface layer of said weak soil layer *a* is turned into stabilized foundation ground 1 to a fixed depth by giving stabilization treatment with a solidifier agent hereinafter described in detail.

Figure 2:
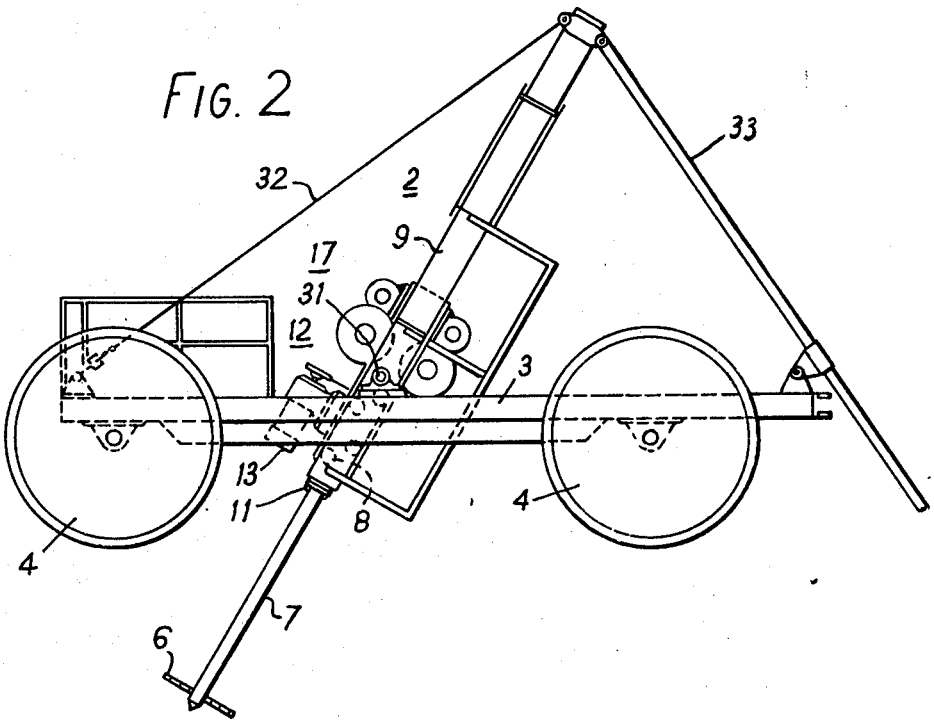
FIG. 2 is an elevation of an example of apparatus for carrying out the method of the present invention.

A treatment apparatus 2 as shown in FIG. 2 is employed for this stabilization treatment. Said treatment apparatus is mounted on a chassis 3 which is supported by wheels 4, said wheels being hollow so that the treatment apparatus can move, when floating on said weak soil layer, by rotation of said wheels. If said weak soil layer exists below water, floats will be employed to take the place of said wheels 4.

Figure 3:
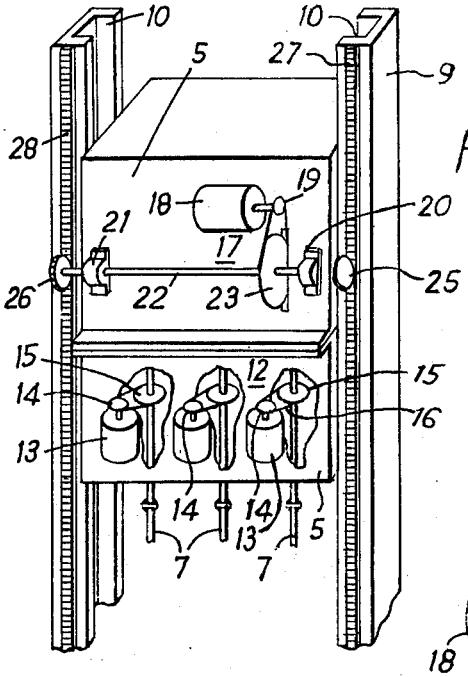
FIGS. 3, 4 and 5 are detailed views of parts of the apparatus, FIG. 3 being a perspective, FIG. 4 being a sectional view of FIG. 3 taken along the line IV — IV thereof, and FIG. 5 being a partially sectioned view of agitator impeller.
Figure 4:
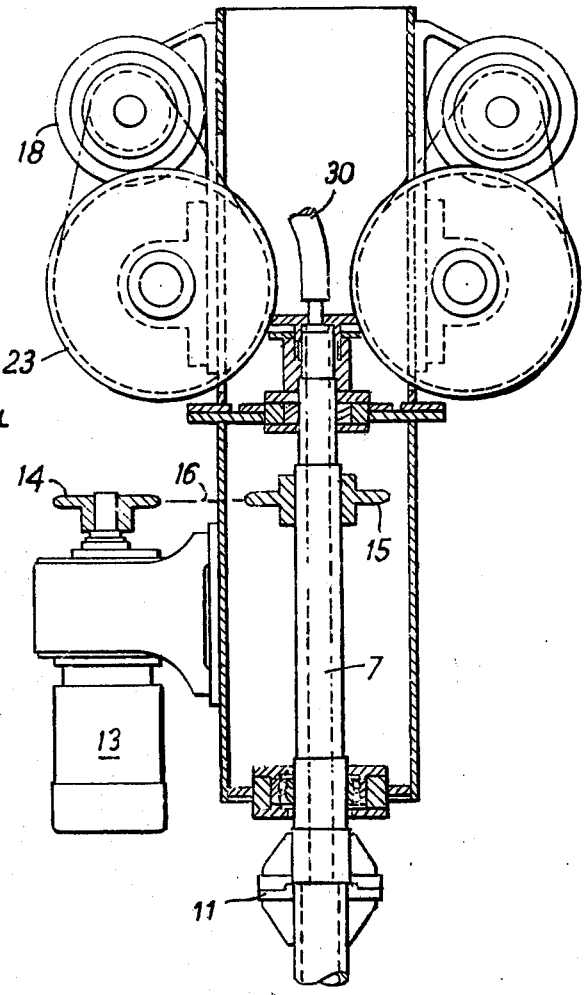
Figure 5:
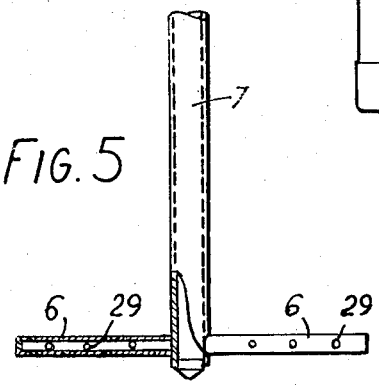

The detailed structure of said treatment apparatus is illustrated in FIG. 3, 4 and 5. Referring to these figures, a frame body 5 rotatably supports rotary shafts 7 which are each provided with agitator impeller casings 6 on the end thereof. Guide rollers 8 are provided at both sides of said frame body 5 and said guide rollers are disposed in guide grooves 10 provided in the inside faces of guide pillars 9. Said rotary shafts 7 have an end portion, carrying the agitator impeller casings 6, connected by means of flange couplings 11.

A rotary drive mechanism 12 consists of an electric motor 13 fixed on an outer wall of said frame body 5, and a chain passed about a sprocket 14 fixed on drive shaft of said motor 13 and a sprocket 15 fixed on said rotary shaft 7.

An elevating mechanism 17 consists of an electric motor 18 fixed on the outer wall of said frame body 5, a sprocket 19 fixed on the drive shaft of said motor 18, a sprocket 23 fixed on a rotary shaft 22 rotatably supported by bearings 20 and 21 fixed on the outer wall of said frame body 5, a chain 24 provided between said sprockets 19 and 23, pinions 25 and 26 secured at both ends of said rotary shaft 22, and racks 27 and 28 which are fixed on said guide pillars 9 and are engaged by said pinions 25 and 26. Said pinions 25 and 26 rotate together, driven by the motor 18, for elevating and lowering said frame body 5 along said guide pillars. This elevation mechanism 17 contributes to effective stabilization treatment at necessary points, which is an important object of the present invention, by changing the position of said agitator impellers which are buried in said weak soil layer. The rotary shafts 7 and agitator impeller casings are hollow, and holes 29 are provided in the wall of said agitator impeller casings 6.

A solidifier agent, hereinafter described in detail, is fed into the hollow rotary shaft 7 through a hose 30 and is discharged through said holes 29 in said agitator impeller casings 6 during rotation of said agitator impellers.

Said guide pillars 9 are supported at about mid-position by supporting means 31, and the angle of inclination of said guide pillars 9 may be freely adjusted by wires 32 and stays 33.

In this treatment apparatus, as said wheels rotate intermittently or continuously, said rotary shafts 7 rotate driven by the motor 13, and said frame body 5 is elevated and/or lowered by said motor 18. The agitator impeller casings 6, discharge the solidifier agent through the holes 29 whilst agitating the weak soil layer, thereby performing stabilization treatment. The treatment apparatus is preferably of self-driven type, but may also be moved by traction means such as a winch or the like.

The solidifier agents to be employed for stabilization treatment of the weak soil layer, in the present invention, are moldable compounds for land hardening made by blending a component A (75 - 95% by weight) with a component B (5 - 25% by weight) blended with such industrial residues (40 - 60% by weight) as calcium hydroxide, carbite residue, aluminium residue, nickel residue and mineral residue, silicic acid material (10 - 20% by weight), pulped residual lignin material (1 - 2% by weight), and Portland cement (5 - 40% by weight), all of which are heated to a temperature from 500° to 1000° C, and thereafter molding or forming it into granules, the compound material having chloride (10 - 15% by weight) (but as a liquid of baume 35°) magnesium and/or calcium such as magnesium chloride and calcium chloride, fabric material powder (15 - 20% by weight) such as wood powder and/or pulp chips, and calcium hydroxide (65 - 80% by weight).

These moldable compounds for land hardening are marketed under the brand names "Chemicolime" and "Fujibeton."

The solidifier agents described above in detail are made into a slurry and then fed into the hollow part of the rotary shafts 7 from a supply unit on the chassis 3. Alternatively, the solidifier agent may be fed into the rotary shafts 7 through a hose from a supply unit mounted on land.

Figure 6:
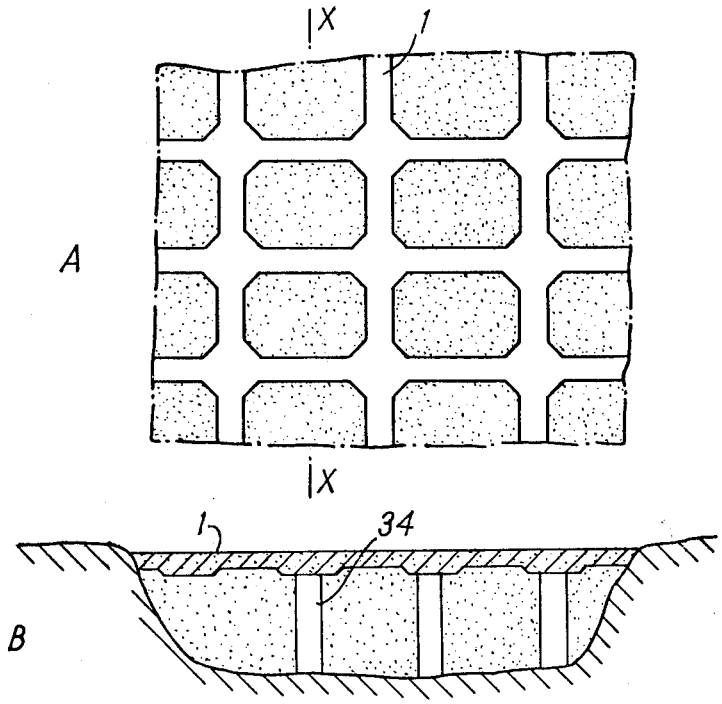
FIG. 6 shows another example of the method of stabilization treatment, A being a plan view, and B being a side sectional view of A taken along the line X — X thereof.

When the method of the present invention is carried into effect, the whole surface layer may be hardened by the stabilization treatment, but it is also effective if the surface layer is partially hardened in a grid pattern as shown in the plan view of FIG. 6. In this case, it is recommended that square or rectangular unhardened parts of said surface layer are strengthened by banking after providing nets, mats, and/or sheets thereon.

An important feature of the construction method of the present invention is that the stabilization-treated parts do not lie scattered in or on said weak soil layer but are linked to each other in a continuous plane surface. The depth of surface layer to be hardened with stabilization treatment usually means a depth from 1.0 meter to 3.0 meters. From practical examples of carrying out the method of the present invention, performed by the inventor, it has been found that there is no problem in obtaining and using this depth of stabilization treatment when building ordinary housing and parkland.

On the other hand, when erecting larger buildings and/or multistory houses, it is usually necessary to drive in piles, to partially reinforce the foundation of said buildings and houses, until said piles reach the rocky ground base. However, in the construction method of the present invention, it is not necessary to carry out such piling work in the above cases. Namely, when some supporting columns 34 are required as shown in FIG. 6-B, the wheels and/or floats of the treatment apparatus are made to stop during the stabilization treatment of said surface layer of said weak soil layer, and the agitator impellers of said treatment apparatus are lowered to or near to the rocky ground base, thereby readily forming said supporting columns necessary for construction of heavyweight structures. Alternatively, after said surface layer has been hardened to or at a certain fixed depth by the stabilization treatment, the rotary shaft may be replaced, by uncoupling the flange or coupling 11, with a longer shaft, thereby easily and smoothly forming said supporting columns 34.

Figure 7:
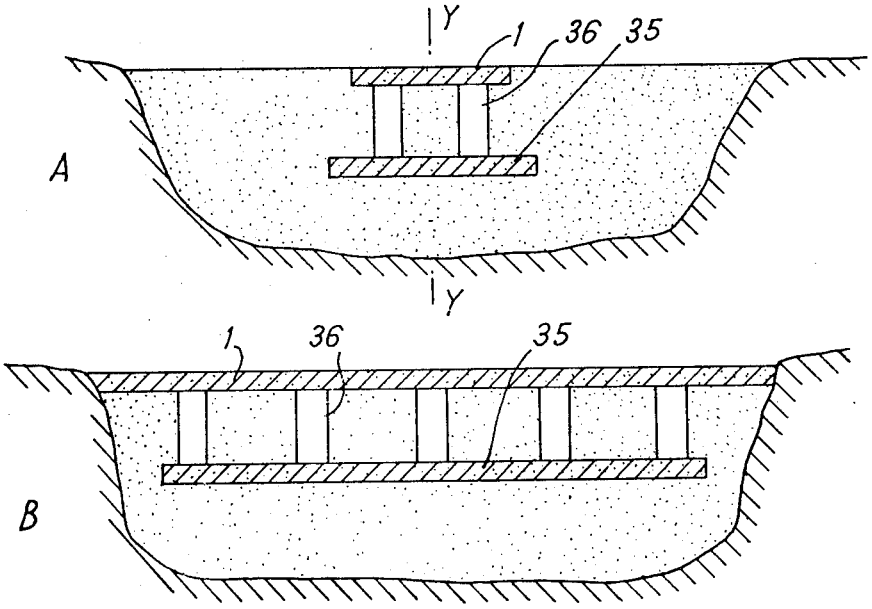
FIG. 7 shows still another example of the method of stabilization treatment, A being a plan view, and B being a side sectional view of A taken along the line Y — Y.

The above practical examples illustrate the cases where said supporting columns are so formed that they reach the rocky ground base. However, there is no problem in having supporting columns 34 formed halfway, without reaching the rocky ground base. As is shown in FIGS. 7-A and -B, the surface layer 1 which is hardened to a certain fixed depth by the stabilization treatment may be linked by supporting columns 36 with another layer which is preliminary treated to be hardened to a certain fixed depth and to a certain fixed extent under said surface layer 1. Said treated and hardened surface layer can be effectively employed to form road function, especially for transportation vehicles of heavy goods.

Furthermore, as shown in FIG. 1, if simply ribs P are provided at suitable intervals when said hardening and stabilization treatment of said surface layer is carried out, said ribs P are very effective for increasing the rigidity of said hardened and treated layer and for promoting the durability of said layer.

What is claimed is:

1. A method, for the treatment of weak soil to provide stabilized land, comprising the steps of:

(i) moving an agitating means within said weak soil in a first lateral direction and simultaneously up and down so as to obtain the agitation of a first layer having length and breadth and having a depth corresponding to the extent of up and down movement, (ii) simultaneously with said movement of the agitating means, feeding to the soil being agitated in the vicinity of the agitating means a soil stabilizer material, (iii) repeating steps (i) and (ii) with the agitating means moved through a different portion of depth in the weak soil so as to obtain a second layer of treated soil spaced in the up or down direction from said first layer, (iv) moving said agitating means, simultaneous feeding of said soil stabilizer material, up or down from the position of said first layer to the position of said second layer but without lateral movement, thereby to form a column of stabilized soil integral with both of said layers, steps (iii) and (iv) being in either order.

2. A method for the treatment of weak soil to provide stabilized land, as claimed in claim 1 wherein said layers are laterally spaced from each other by layers which are left untreated.

* * * * *